US005984276A

United States Patent [19]

Green

[11] Patent Number: 5,984,276

[45] Date of Patent: Nov. 16, 1999

[54] CABLE RETRACTION SPEED LIMITER FOR AIR BALANCING HOIST

[75] Inventor: Joseph H. Green, Tampa, Fla.

[73] Assignee: Tri-Motion Industries, Inc., Tampa, Fla.

[21] Appl. No.: 09/162,688

[22] Filed: Sep. 29, 1998

[51] Int. Cl.[6] ..... B66D 3/20

[52] U.S. Cl. ..... 254/360; 254/386

[58] Field of Search ..... 254/267, 360, 254/386

[56] References Cited

U.S. PATENT DOCUMENTS

| | | | |
|---|---|---|---|
| 3,537,686 | 11/1970 | McKendrick | 254/168 |
| 3,635,442 | 1/1972 | Ulbing | 254/168 |
| 3,656,715 | 4/1972 | Powell | 254/168 |
| 3,675,899 | 7/1972 | McKendrick | 254/168 |
| 4,114,736 | 9/1978 | Scherenberg | 191/12.4 |
| 4,254,941 | 3/1981 | Tanson | 254/267 |
| 4,455,013 | 6/1984 | Fischer et al. | 254/386 |
| 4,611,787 | 9/1986 | May et al. | 254/267 |
| 4,691,875 | 9/1987 | Higbee | 242/107.4 B |
| 4,865,263 | 9/1989 | Ervin | 242/107.2 |
| 5,370,367 | 12/1994 | Zaguroli, Jr. | 254/360 |
| 5,522,581 | 6/1996 | Kulhavy | 254/267 |
| 5,553,832 | 9/1996 | Zaguroli, Jr. | 254/267 |
| 5,735,507 | 4/1998 | Sierra Escudero et al. | 254/391 |

*Primary Examiner*—Katherine A. Matecki
*Attorney, Agent, or Firm*—Gifford, Krass, Groh, Sprinkle, Anderson & Citkowski, P.C.

[57] ABSTRACT

A cable retraction speed limiter has a body which is designed to be mounted on the housing of a hoist and a spool which is rotatably supported by the body. A flexible extension member is disposed about the spool so that it can be extended from and retracted onto the spool by rotation of the spool. The end of the flexible extension member is designed to be attached to an air pressure responsive member inside of the air balancing hoist. The cable retraction speed limiter also includes a spool lock that stops rotation of the spool when the rotational speed of the spool exceeds the rotational speed limit, thereby limiting the hoist cable retraction speed.

6 Claims, 2 Drawing Sheets

CABLE RETRACTION SPEED LIMITER FOR AIR BALANCING HOIST

FIELD OF THE INVENTION

The present invention relates generally to cable speed limiters and, more specifically, to cable retraction speed limiters for hoists to prevent rapid retraction of a hoist cable when a load is released.

BACKGROUND OF THE INVENTION

Manufacturing and assembly plants, as well as machine shops and garages, often require heavy objects to be lifted, moved to a new location, and released. Many types of hoists have been developed to facilitate the lifting of objects too heavy for humans to lift safely or comfortably without assistance. One particularly useful type of hoist is known as an air balancing hoist. Several versions of air balancing hoists are available. All use air pressure to operate the hoist. Typically, an air balancing hoist includes a housing with an air pressure responsive member movable therein. A cable is connected to the air pressure responsive member such that movement of the air pressure responsive member causes extension or retraction of the cable from the housing. The end of the cable extending from the housing is connected to an object to be lifted and then pressurized air is introduced into the hoist housing. When the air pressure inside the housing reaches a certain level, the air pressure responsive member begins to move and retract the cable toward the housing so that the object connected to the cable is lifted. By controlling the amount of pressure inside the housing, the weight of the object to be lifted can be "balanced" so that the object can be easily moved to another location. When the object to be moved has been positioned at its destination, air pressure in the hoist housing is bled off causing the air pressure responsive member to move and extend the cable, releasing the load.

Under some circumstances, the object to be moved may be released suddenly from the end of the hoist cable without pressure first being removed from the housing. In these circumstances, the weight of the load is no longer available to balance with the air pressure inside of the hoist housing. Therefore, the air pressure responsive member moves very rapidly causing the cable to be retracted very quickly into the housing. This sudden, rapid retraction of the cable is undesirable for several reasons. Rapid retraction of the cable may cause the cable end to whip around in a dangerous manner. Also, the hoist operator may not want the end of the cable to retract entirely into the housing. The operator may wish to lift another object at a similar height to which the first object was released. If the end of the cable is retracted rapidly, the operator must re-extend the cable before the hoist is in a position to be used again. Also, rapid, lengthy travel of the cable and the air responsive member leads to additional wear and tear on the hoist.

There have been numerous attempts to provide cable retraction speed limiters to solve the problem of sudden rapid cable retraction. However, these prior approaches typically rely on some type of brake and are large and complicated. This makes it difficult to package the devices and also increases their costs. There remains a need for a simple and compact cable retraction speed limiter which may be incorporated into new air balancing hoists or retrofitted onto existing air balancing hoists.

SUMMARY OF THE INVENTION

The cable retraction speed limiter of the present invention is simple, compact, and can be incorporated in new air balancing hoists as well as retrofitted to existing hoists. It is designed for use with air balancing hoists of the type having a housing with an air pressure responsive member that is linearly movable therein. The housing has a mounting region. The air pressure responsive member is movable in a positive direction which causes extension of the hoist cable, and in a negative direction which causes retraction of the hoist cable. The negative direction is the direction away from the mounting region of the housing. The cable retraction speed limiter includes a body that is physically configured for mounting on the housing of the hoist in the mounting region and a spool that is rotatably supported by the body. The spool is rotatable in a first direction and in a second direction. A flexible extension member is disposed about the spool and extensible therefrom. Extension of the extension member causes rotation of the spool in the first direction, and rotation of the spool in the second direction causes retraction of the extension member. The flexible extension member has an end that is designed to be attached to the air pressure responsive member of an air balancing hoist. The speed limiter also includes a lock for locking the spool. The lock stops rotation of the spool in the first direction when the rotational speed of the spool exceeds a rotational speed limit. It is preferred that the spool lock is a mechanical inertial lock and that the flexible extension member is an elongated web of woven material.

DETAILED DESCRIPTION OF THE PREFERRED EMBODIMENTS

Figure 1:
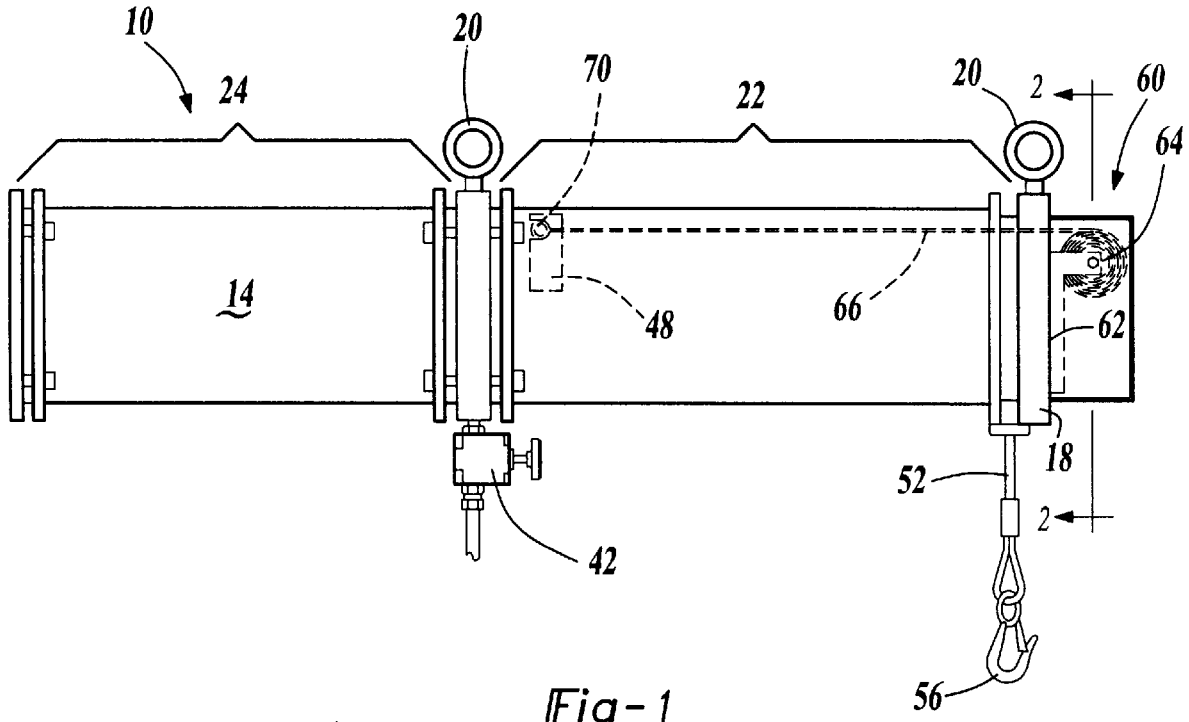
FIG. 1 is an elevational side view of an air balancing hoist with the preferred embodiment of the cable retraction speed limiter according to the present invention installed thereon.
Figure 2:
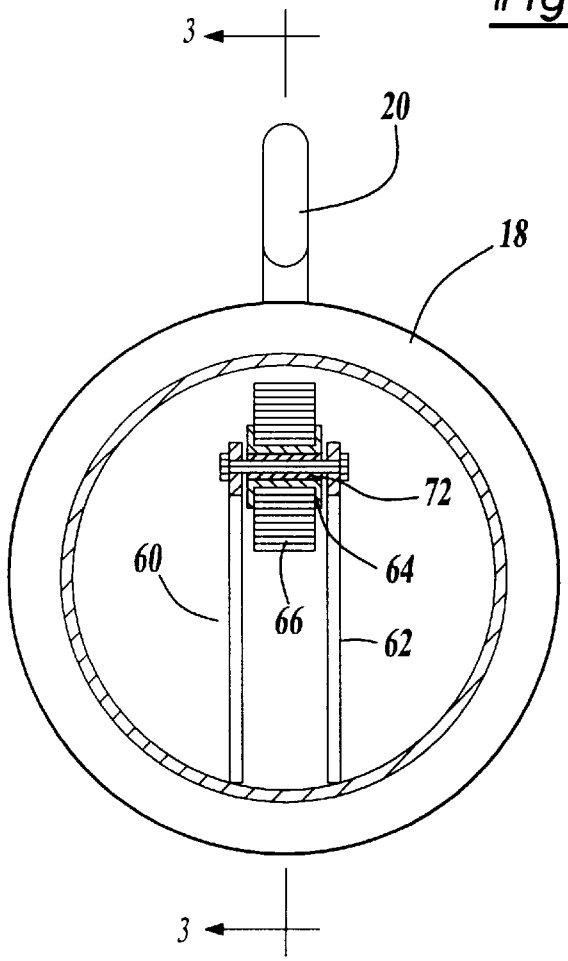
FIG. 2 is a cross-sectional view of the speed limiter of FIG. 1 taken along lines 2—2.
Figure 3:
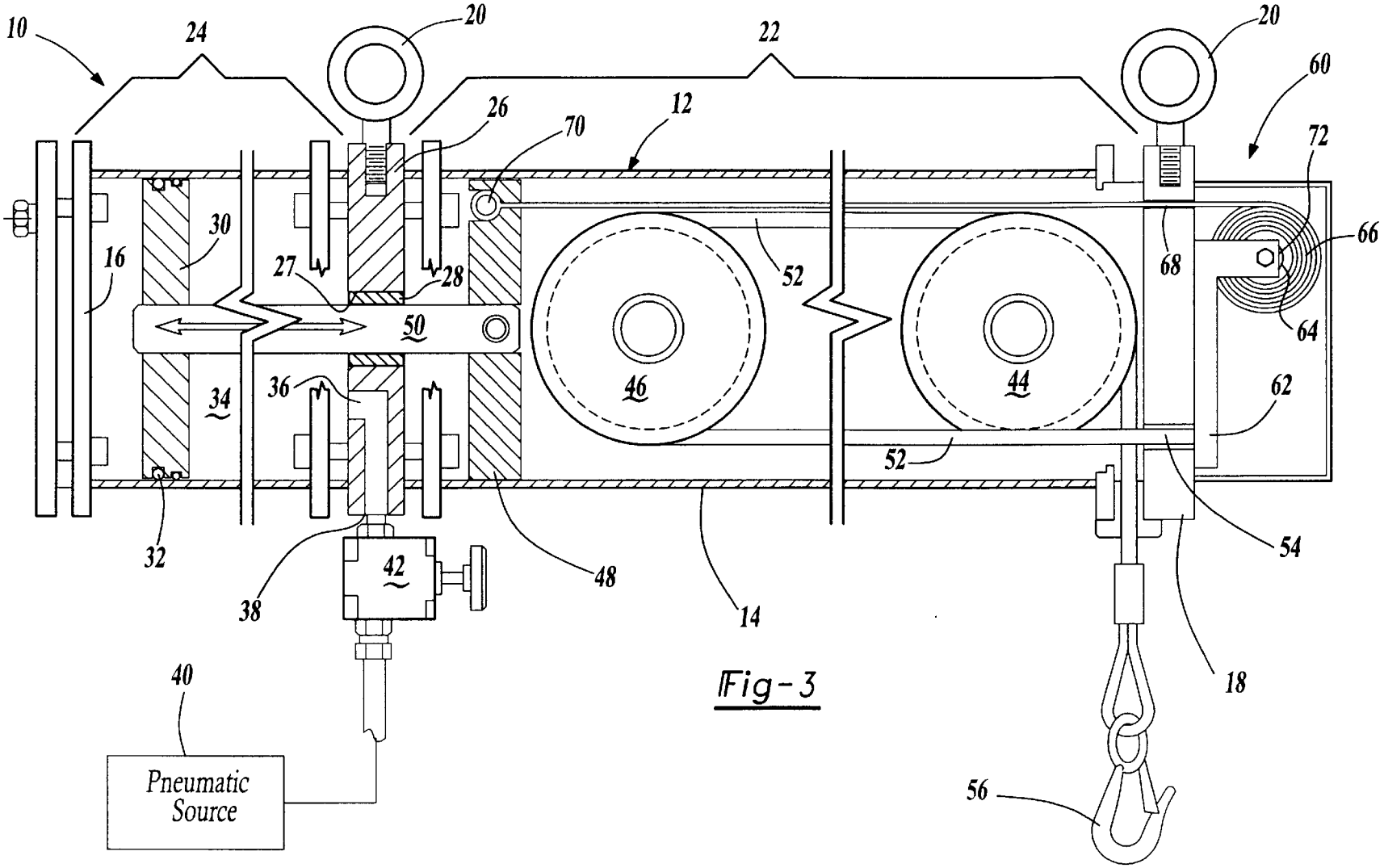
FIG. 3 is a cross-sectional side view of the cable retraction speed limiter and air balancing hoist of FIGS. 1 and 2, taken along lines 3—3 of FIG. 2.

Referring to the figures, in which the numbers refer to the same elements throughout, an air balancing hoist of the type for use with the present invention is generally shown at 10. The air balancing hoist 10 includes a housing 12 including a cylindrical main portion 14 with a first end cap 16 and a second end cap 18 closing off the ends of the main portion 14. In the embodiment shown, the first end cap 16 closes off the end of the cylindrical main portion 14 and is comprised essentially of a circular flat piece of metal. However, the second end cap 18 is significantly more massive and serves both to close off the other end of the cylindrical main portion 14 of the housing 12 and also serves as a support for the hoist 10. A lifting loop 20 engages the top of the second end cap 18 and is designed to be hooked to an overhead support such as a hoist conveyor near the ceiling of a factory. The lifting loop 20 supports the second end cap 18 which in turn supports the housing 12 and the remainder of the hoist 10.

The hoist 10 is generally divided into two sections, referred to herein as a cable section 22 and an air pressure section 24. The two sections 22, 24 are generally separated by a support member 26. Like the second end cap 18, the support member 26 is a structural member designed to support the hoist 10. Another lifting loop 20 engages the support member 26. Together, the two support loops 20 cooperate to support the hoist 10. The support member 26 comprises a generally circular member that engages and supports the cylindrical main portion 14 of the housing 12 and is positioned between the first end cap 16 and second end cap 18. Therefore, the cable section 22 of the hoist 10 is defined as the portion of the hoist 10 between the support member 26 and the second end cap 18, and the air pressure section 24 of the hoist 10 is defined as the portion of the hoist 10 between the first end cap 16 and the support member 26. The first end cap 16, second end cap 18, and support member 26 are all generally parallel to each other and parallel to a plane which is perpendicular to the main axis of the elongated cylindrical main portion 14 of the housing 12.

Located inside the air pressure section 24 of the cylindrical main portion 14 of the housing 12 is a circular piston 30 which sealingly engages the cylindrical main portion 14 via a circumferential seal 32. The piston 30 is generally parallel to the first end cap 16 and the support member 26. The area between the piston 30 and the support member 26 is sealed so as to hold air pressure and will be referred to herein as an air pressure chamber 34. Therefore, the air pressure chamber 34 is defined as the area within the cylindrical main portion 14 of the housing 12 between the piston 30 and the support member 26. Piston 30 is linearly movable toward and away from the support member 26 thereby changing the size of the air pressure chamber 34. Support member 26 further includes a passageway 36 which extends from the air pressure chamber 34 to a supply port exterior to the hoist housing 12. A pneumatic source 40 is connected to the supply port via a control valve 42 so that pressurized air can be fed to, and bled off from, the air pressure chamber 34.

The piston 30 is shaped as a circular disc. A connecting rod 50 extends from the center of the circular disc-shaped piston 30 through a hole 27 in the center of the support member 26. A seal 28 positioned in the hole 27 engages the sides of the connecting rod 50 so as to seal the air pressure chamber 34. The connecting rod 50 passes through the support member 26 from the air pressure section 24 of the hoist 10 to the cable section 22 of the hoist where it connects to a movable disc 48. The movable disc 48 is positioned in the cable section 22 of the air balancing hoist 10 and is generally parallel with the piston 30. Because the connecting rod interconnects them, the movable disc 48 and the piston 30 move together.

Moving now to the other side of the support member 26, the cable section 22 of the hoist 10 includes a first pulley 44 and a second pulley 46 that are mounted inside the housing 12. Each pulley 44, 46 is supported for rotation about an axis perpendicular to the central axis of the elongated cylindrical main portion 14 of the housing 12. The first pulley 44 is supported adjacent second end cap 18 at a fixed distance from the second end cap 18. The second pulley 46 is mounted to the movable disc 48 between the support member 26 and the first pulley 44. Because the movable disc 48 is interconnected with the piston 30, the relative distance between the first pulley 44 and the second pulley 46 varies directly with movement of the piston 30.

A cable 52 has a first end 54 which is connected to the second end cap 18. The cable 52 extends away from the second end cap 18, toward the movable disc 48 and the support member 26 where it passes around second pulley 46. From there, the cable 52 extends back toward the second end cap 18 where it passes around first pulley 44 and then extends downwardly out of the housing 12 of the hoist 10 and terminates in a lifting hook 56. Because the cable 52 passes around both the first 44 and second 46 pulleys, movement of the second pulley 46 away from the first pulley 44 causes retraction of the lifting hook 56 towards the housing 12 of the hoist 10. Therefore, movement of the piston 30, which causes movement of the movable disc 48 and the connected second pulley 46, causes retraction and extension of the cable 52 from the hoist 10. In FIG. 1, the hoist 10, as illustrated, would have very limited travel. As will be clear to one of skill in the art, the length of the cable section 22 and air compressor section 24 of the hoist 10 may be increased so as to increase the retraction and extension capabilities of the hoist 10.

In use, a load is connected to the lifting hook 56, creating tension in the cable 52 and biasing the pulleys 44, 46 towards one another. This causes the movable disc 48, the connecting rod 50, and the piston 30 to move toward the second end cap 18, thereby reducing the size of the air pressure chamber 34. To counteract this load, pressurized air from the pneumatic source 40 is introduced into the air pressure chamber 34 via the control valve 42 and passageway 36. Pressurized air is fed into the air pressure chamber 34 until the pressure in the chamber 34 is sufficient to counteract the tension in the cable 52. At the point at which cable 52 is neither extending nor retracting, the load on the lifting hook 56 is balanced by the air pressure in the air pressure chamber 34. When additional pressurized air is introduced into the air pressure chamber 34, the load will no longer be balanced and the piston 30 will move away from the support member 26, thereby increasing the volume of the air pressure chamber 34 and retracting the cable 52 into the housing 12. If instead, pressurized air is bled off from the air pressure chamber 34 through the control valve 42, the air pressure in the air pressure chamber 34 will become insufficient to balance the load on the lifting hook 56 causing the air pressure chamber 34 to shrink and the piston 30 to move towards the support member 26, thereby extending the cable 52.

As can be seen from this basic discussion of the principles underlying the operation of an air balancing hoist 10, the load may be lifted, lowered or balanced in a simple manner by introducing or bleeding off pressurized air from the air pressure chamber 34. In use, air pressure is bled off from the air pressure chamber 34 so as to extend the cable 52 until the lifting hook 56 is in the desired position for lifting the load. At that point, the lifting hook 56 is connected to the object to be lifted and pressurized air is introduced into the air pressure chamber 34. This is continued until the object is lifted to the desired height and the control valve 42 is shut off. At this point the load on the lifting hook 56 is balanced and may be moved to another location.

At times, the hoist operator may need to move a heavy object to a position where the object will be grabbed by a robotic device causing the load on the lifting hook 56 to be suddenly removed. In a situation such as this, the air pressure in the air pressure chamber 34 is suddenly no longer balanced by a load on a cable 52 and therefore the piston 30 moves rapidly away from the support member 26, thereby rapidly retracting the cable 52 into the housing 12. To counteract this rapid retraction, a cable retraction speed limiter according to the present invention is provided.

The cable retraction speed limiter is generally shown at 60. The speed limiter 60 includes a body 62 which is either bolted or welded to the second end cap 18 of the hoist 10. Body 62 is essentially an L-shaped bracket with the long part of the L fixed to the second end cap 18 and the short portion of the L extending perpendicularly therefrom. The short portion of the L-shaped body 62 supports a spool 64 for rotation about an axis parallel to the axis of rotation of the first and second pulleys 44, 46.

A flexible extension member 66 is disposed on the spool 64. The flexible extension member 66 is preferably a web of woven material such as the material out of which seat belts are made. Flexible extension member 66 extends from the spool 64 through a slot 68 in the second end cap 18 where it passes through a portion of the inside of the cable section 22 of the hoist 10. The flexible extension member has an end 70 which is connected to the movable disc 48 so that movement of the movable disc, with the piston 30, causes extension and retraction of the flexible extension member from the spool 64. The extension of the flexible extension member 66 from the spool 64 causes rotation of the spool 64 in a direction defined herein as a first direction. This corresponds to movement of the moveable disc 48 away from the second end cap 18 which also corresponds to retraction of the cable 52 into the hoist housing 12.

The cable retraction speed limiter 60 further includes a spool lock 72 for stopping rotation of the spool 64 in the first direction when the rotational speed of the spool 64 exceeds a rotational speed limit. As will be clear to one of skill in the art, the spool lock 72 may be of several designs. Preferably, the spool lock is a mechanical inertial lock similar in design to the inertial locks used for seat belt mechanisms. In these mechanisms, the lock responds to the rotational speed of the spool so as to move locking members into locking positions as the rotational speed increases. Thereby, the maximum rotational speed of the spool is limited. This limits the speed at which the flexible extension member 66 may be extended from the spool 64, which in turn limits the speed at which the cable 52 can be retracted into the hoist 10.

In operation, when the load is suddenly released from lifting hook 56, the cable 52 will begin to rapidly retract into the housing 12 as the piston 30 and movable disc 48 move away from the second end cap 18. This will cause rapid extension of the flexible extension member 66 from the spool 64, which in turn will cause the spool lock 72 to lock the spool 64 preventing further extension of the flexible extension member 66. This will cause the movable disc 48 to cease moving away from the second end cap 18 thereby halting the retraction of the cable 52 into the housing 12 of the hoist 10. At this point, the operator will bleed off the pressure from the air pressure chamber 34 using the control valve 42 until the cable 52 may once again be extended. As the inertial locking mechanism of the spool lock 72 will now be rotated in a direction opposite to the first direction, the spool lock 72 will be released allowing the cable 52 to be extended. The operator may then extend or retract the cable 52 as desired. The cable retraction speed limiter 60 will only intervene when the retraction speed is too high.

As will be clear to one of skill in the art, the rotational speed at which the spool lock 72 locks the spool 64 may be chosen so as to provide different rotational speed limits.

In view of the teaching presented herein, other modifications and variations of the present invention will be readily apparent to those of skill in the art. The foregoing drawings, discussion, and description illustrate some embodiments of the present invention, but are not meant to be limitations on the practice thereof. It is the following claims, including all equivalents, which define the scope of the invention.

I claim:

1. A cable retraction speed limiter for stopping the retraction of a cable into an air balancing hoist when the retraction speed exceeds a limit, said hoist having a housing and an air pressure responsive member that is linearly movable therein, the housing having a mounting region, the air pressure responsive member engaging the cable and being movable in a positive direction causing extension of the cable and in a negative direction causing retraction of the cable, the negative direction being a direction away from the mounting region, said speed limiter comprising:

a body including means for mounting on the housing of the hoist in the mounting region;

a spool rotatably supported by said body for rotation about a first axis, said spool being rotatable in a first direction and a second direction;

a flexible extension member disposed about said spool and extensible therefrom, extension of said extension member causing rotation of said spool in said first direction and rotation of said spool in said second direction causing retraction of said extension member, said flexible extension member having at an end thereof means for attachment to the air pressure responsive member;

a spool lock for locking said spool, said lock stopping rotation of said spool in said first direction when the rotational speed of said spool exceeds a rotational speed limit.

2. The cable retraction speed limiter of claim 1, wherein the spool lock is a mechanical inertial lock.

3. The cable retraction speed limiter of claim 1, wherein the flexible extension member is an elongated web of woven material.

4. An improved air balancing hoist comprising:

a housing having a mounting region thereon;

an air pressure responsive member that is linearly movable within said housing, said member being movable in a positive direction and a negative direction, said negative direction being a direction away from said mounting region;

a cable connected to said air responsive member and being extensible from said housing for lifting objects, said cable connected to said air responsive member such that movement of said member in said positive direction causes extension of said cable and movement of said member in said negative direction causes retraction of said cable; and a cable retraction speed limiter for stopping the retraction of said cable into said housing when the retraction speed exceeds a limit, said speed limiter comprising:

a body mounted on said housing of said hoist in said mounting region;

a spool rotatably supported by said body for rotation about a first axis, said spool being rotatable in a first direction and a second direction;

a flexible extension member disposed about said spool and being extensible therefrom, extension of said extension member causing rotation of said spool in said first direction and rotation of said spool in said second direction causing retraction of said extension member, said flexible extension member having an end connected to said air pressure responsive member such that movement of said air pressure responsive member in said negative direction causes rotation of said spool in said first direction; and a spool lock for locking said spool, said lock stopping rotation of said spool in said first direction when the rotational speed of said spool exceeds a rotational speed limit.

5. The cable retraction speed limiter of claim 4, wherein the spool lock is a mechanical inertial lock.

6. The cable retraction speed limiter of claim 4, wherein the flexible extension member is an elongated web of woven material.

* * * * *